US005254239A

United States Patent [19]

Matyi et al.

[11] Patent Number: 5,254,239

[45] Date of Patent: Oct. 19, 1993

[54] MASK STRIPPER FOR ELECTROFORM PARTING

[75] Inventors: Ernest F. Matyi, Webster; William G. Herbert, Williamson; Gary J. Maier; Loren E. Hendrix, both of Webster, all of N.Y.

[73] Assignee: Xerox Corporation, Stamford, Conn.

[21] Appl. No.: 51,931

[22] Filed: Apr. 26, 1993

[51] Int. Cl.[5] ..... C25D 1/20

[52] U.S. Cl. ..... 205/67

[58] Field of Search ..... 205/67

[56] References Cited

U.S. PATENT DOCUMENTS

| | | | |
|---|---|---|---|
| 4,158,612 | 6/1979 | Luch et al. | 204/12 |
| 4,501,646 | 2/1985 | Herbert | 204/4 |
| 4,549,939 | 10/1985 | Kenworthy et al. | 204/4 |
| 4,711,833 | 12/1987 | McAneney et al. | 430/131 |
| 4,781,799 | 11/1988 | Herbert, Jr. et al. | 204/9 |
| 4,902,386 | 2/1990 | Herbert et al. | 204/9 |
| 5,021,109 | 6/1991 | Petropoulos et al. | 156/137 |
| 5,064,509 | 11/1991 | Melnyk et al. | 204/9 |
| 5,160,421 | 11/1992 | Melnyk et al. | 205/67 |

*Primary Examiner*—T. M. Tufariello

*Attorney, Agent, or Firm*—Zosan S. Soong

[57] ABSTRACT

A method for separating an electroformed article from a mandrel comprising: (a) masking a portion of a mandrel with a mask comprising an electrically nonconductive outer surface; (b) electroforming an article on the mandrel wherein the electroforming material is deposited on the mandrel surface but fails to adhere to the nonconductive outer surface of the mask, whereby the end of the electroformed article is adjacent to the mask; and (c) removing the article from the mandrel by either: (i) pushing the mask against the end of the article to effect movement of the article in the direction of separation; or (ii) removing the mandrel while keeping the mask stationary, whereby the end of the article pushes against the mask during withdrawal of the mandrel.

14 Claims, 2 Drawing Sheets

MASK STRIPPER FOR ELECTROFORM PARTING

This invention relates generally to methods for separating an electroform component from a mandrel, and more particularly to methods employing a mask which also can be used as a provider of a force such as an axial force to initiate movement to the electroform and to move the electroform axially until it is stripped from the mandrel or until the mandrel is stripped from the electroform. The removed electroformed article may be used for example as a substrate in the fabrication of photoreceptors.

Parting of the electroform from the mandrel typically occurs by hand with the worker gripping the central portion of the elctroform during parting. This is disadvantageous since one or more of the following may occur: contamination of the electroform surface such as by dirty or contaminated gloves; marring the finish (matte finish is typically employed to eliminate the plywood phenomenon); scratching or denting the electroform surface; rendering parting more difficult by gripping the electroform which reduces any parting gap between the electroform and the mandrel; and physical damage to the mandrel. There is a need for new separation methods which reduce or eliminate one or more of the above described problems, and this need is met by the present invention.

The use of nonconductive masks to block deposition on parts of a mandrel during electroforming is known. However, the use of a mask in facilitating electroform parting appears to be unknown.

The following documents may be of interest:

Herbert et al., U.S. Pat. No. 4,902,386, discloses a mandrel having an ellipsoid shaped end.

Herbert, U.S. Pat. No. 4,501,646, discloses an electroforming process which effects a parting gap by heating or cooling.

Petropoulous et al., U.S. Pat. No. 5,021,109, discloses devices and methods to facilitate removal of a tubular sleeve from a mandrel, reference for example, col. 11.

Melnyk et al., U.S. Pat. No. 5,064,509, discloses devices and methods to facilitate removal of an electroformed article from a mandrel, reference, cols. 12–13.

McAneney et al., U.S. Pat. No. 4,711,833, discloses air assisted removal of substrates from a mandrel, reference for example, col. 10, lines 30–40.

Kenworthy et al., U.S. Pat. No. 4,549,939, discloses the removal of an electroformed part from a photomask mandrel by a variety of ways, reference, for example, col. 3.

Herbert et al., U.S. Pat. 4,781,799, discloses an elongated electroforming mandrel, the mandrel comprising at least a first segment having at least one mating end and a second segment having at least one mating end, the mating end of the first segment being adapted to mate with the mating end of the second segment.

Melnyk et al., U.S. Pat. No. 5,160,421, discloses the use of a nonconductive coating to block deposition on a portion of a mandrel, reference for example, col. 3, lines 43–48.

Luch et al., U.S. Pat. No. 4,158,612, discloses a polymeric mandrel for electroforming and a method of electroforming.

SUMMARY OF THE INVENTION

It is an object of the present invention to provide drel by employing a mask to control the terminus of deposition of material during electroforming and to use the mask as a stripper.

It is a further object in embodiments to select materials for the mandrel and the electroformed article having similar or different coefficients of expansion.

It is another object in embodiments to employ electroform parting methods which reduce or eliminate one or more of the following: contamination of the electroform surface such as by dirty or contaminated gloves; marring the finish (matte finish is typically employed to eliminate the plywood phenomenon); scratching or denting the electroform surface; making parting more difficult by gripping the electroform which reduces any parting gap between the electroform and the mandrel; and physical damage to the mandrel.

These objects and others are accomplished in embodiments by a method for separating an electroformed article from a mandrel comprising: (a) masking a portion of a mandrel with a mask comprising an electrically nonconductive outer surface; (b) electroforming an article on the mandrel wherein the electroforming material is deposited on the mandrel surface and substantially fails to adhere to or does not adhere to the nonconductive outer surface of the mask, whereby the end of the electroformed article is adjacent to the mask; and (c) removing the article from the mandrel by: (i) pushing the mask against the end of the article to effect movement of the article in the direction of separation; or (ii) removing the mandrel while keeping or retaining the mask stationary, whereby the end of the article pushes against the mask during withdrawal of the mandrel.

BRIEF DESCRIPTION OF THE DRAWINGS

Other aspects of the present invention will become apparent as the following description proceeds and upon reference to the Figures, which represent preferred embodiments.

DETAILED DESCRIPTION

Figure 1A:
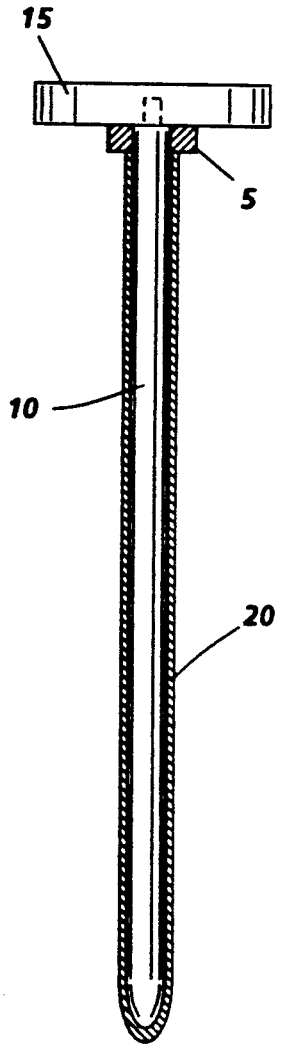
FIGS. 1(*a*) and (*b*) are schematic illustrations of one method to separate an electroform from the mandrel.
Figure 1B:
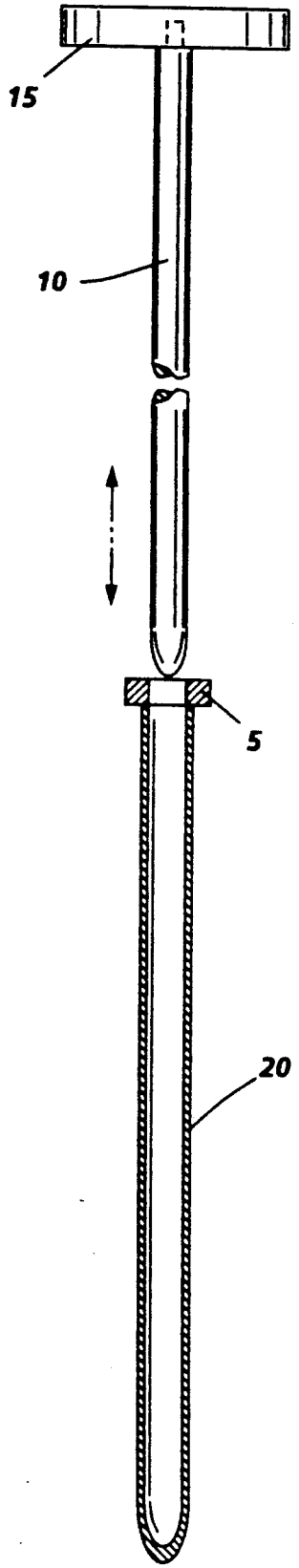

In FIG. 1(*a*), mask 5 is positioned at the top of mandrel 10. Electroform 20 is deposited by electroforming on mandrel 10 but no electroforming material is deposited on mask 5 due to its electrically nonconductive outer surface. Mandrel 10 is fixedly coupled to support 15. In FIG. 1(*b*), electroform 20 is separated from mandrel 10 by pushing mask 5 against the end of electroform 20 and maintaining a force against the end thereof. Once the "sticking force" is overcome between the electroform and mandrel, the electroform is pushed off the mandrel by the mask. The force employed to push the mask against the electroform and to move the mask and electroform may be manual force or the force may be supplied by any suitable mechanical apparatus including gripping devices and motors. The mandrel and the support typically remain stationary during parting of the electroform.

Figure 2A:
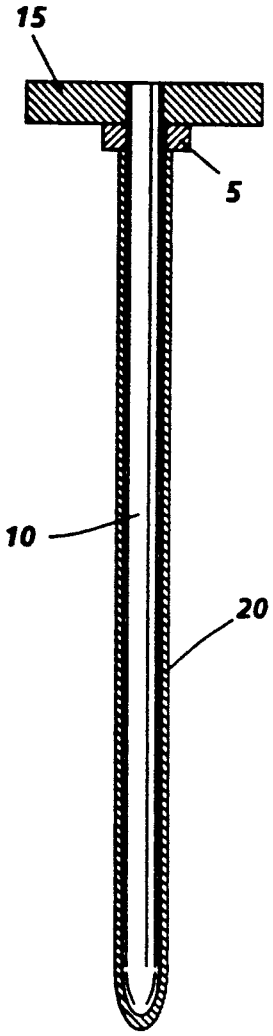
FIGS. 2(*a*) and (*b*) are schematic illustrations of another method to separate an electroform from the mandrel.
Figure 2B:
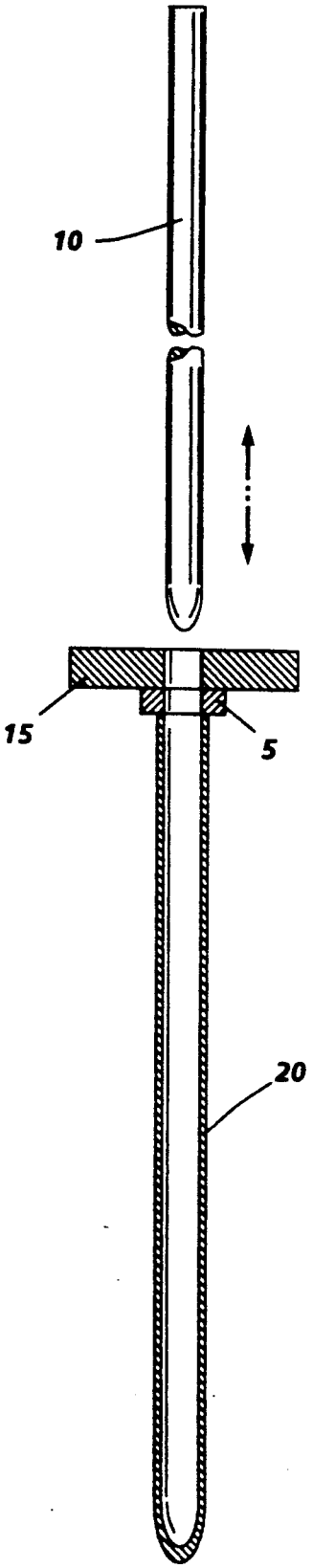

In FIG. 2(*a*), mask 5 is positioned at the top of mandrel 10. Electroform 20 is deposited on mandrel 10 but no material is deposited on mask 5 due to its electrically coupled to support 15. In FIG. 2(*b*), electroform 20 is separated from mandrel 10 by pulling mandrel 10 out, whereby the end of electroform 20 pushes against the mask during withdrawal of the mandrel. Mask 5 is kept stationary by its presence adjacent to support 15. Once the "sticking force" is overcome between the electroform and mandrel, the electroform progresses off the mandrel as the mandrel is being withdrawn. The force employed in pulling out the mandrel may be manual force or the force may be supplied by any suitable mechanical apparatus including gripping devices and motors. In a preferred embodiment, the apparatus to pull out the mandrel may be a threaded device that engages the end or the outer surface of the mandrel to apply axial force for mandrel removal, wherein the end or the outer surface of the mandrel may be grooved or threaded to engage the device.

In FIGS. 1 and 2, the support provides a handling apparatus of the assembly for immersion into the electroforming bath, a means to transport the assembly from the electroforming bath to a remote parting station for electroform removal, and/or to provide electrical continuity to the mandrel. The support may be coupled to the mandrel by any suitable technique. In embodiments, coupling between the mandrel and support is accomplished by one or more of the following: threaded connection; interference or press fit; and slipfit and fastening screws, either from the end or sides of the support or both.

In FIGS. 1 and 2, an optional electrically nonconductive bottom mask, positioned at the parabolic or ellipsoid shaped end of the mandrel, may be employed to control the bottom terminus of deposition of material during electroforming in combination with the top mask. In embodiments, the bottom mask may be removed and the separation proceeding as described herein for FIGS. 1 and 2 where the top mask functions as the stripper. In a modification of FIG. 1 where the top mask is removed and the mandrel is detached from the support, the bottom mask functions as the stripper in a manner similar to the top mask by pushing against the electroform end and forcing the electroform off the mandrel. In embodiments, the bottom mask may have the same configuration and composition as the top mask.

In FIGS. 1 and 2, contact such as by gripping is preferably made only with the mask, the support, or both mask and support but not the electroform surface. This is to reduce or eliminate one or more of the following: contamination of the electroform surface such as by dirty gloves; marring the finish (matte finish is typically employed to eliminate the plywood phenomenon); scratching or denting the electroform surface; and making parting more difficult by gripping the electroform which reduces any parting gap between the electroform and the mandrel. In addition, the present invention in embodiments may reduce the possibility of physical damage to the mandrel since contact with the mandrel surface is minimized. After the electroform is stripped off the mandrel, the electroform progresses to the next operational step and the mask and mandrel may be reassembled, inspected and reassembled, or cleaned and reassembled, or otherwise prepared and reassembled and then re-inserted into the electroform bath and additional electroforms may be made.

The mask may be fabricated from any suitable material or materials in a single layer or multilayer design (two or more layers) wherein the mask has an electrically nonconductive outer surface and an inner surface capable of engaging in sliding movement with the mandrel surface. In a single layer design, the mask may be entirely fabricated of electrically nonconductive material. In a mask having two or more layers, the top layer may be nonconductive and the other layer or layers may be fabricated from a conductive material (e.g., metal or a polymeric material impregnated with a conductive material) or from the same or different nonconductive material as that selected for the top layer. In a mask having two or more layers, each layer may be of an effective thickness, preferably ranging from about 0.5 mm to about 2 cm, and more preferably ranging from about 1 mm to about 1 cm. Illustrative mask materials include thermoplastic and thermosetting resins such as rigid polymers (e.g., polyethylene, polypropylene polyvinyl chloride, polymethyl methacrylate, fluoroplastics, ionomers, acrylonitrile butadiene styrene), copolymers (e.g., ethylenepropylene, vinylchloride-acetate, vinylidene chloride-vinylchloride), compounded materials (e.g., polyvinyl chloride plus acrylonitrile butadiene styrene), some elastomers (e.g., ethylene-propylene rubber), and epoxide resins (e.g., diglycidyl ether of bisphenol A (epoxy resin) with dicyandiamide hardener). Other suitable materials include wax. In embodiments, the mask is elastic. A preferred mask material is butyl rubber.

The mask material is selected from the materials disclosed herein such that the mandrel surface and the mask inner surface exhibit a coefficient of static friction effective for sliding movement therebetween, preferably ranging from about 0.05 to about 1, and more preferably 0.05 to about 0.50. Preferably, the mask does not buckle or crimp when it is pushed against the electroform end or when the electroform end presses against the mask edge.

The mask may have any suitable shape and dimensions: preferably a sleeve like band or collar; a thickness preferably ranging from about 1 mm to about 3 cm, and more preferably about 2 mm to about 1 cm; a length preferably ranging from about 5 mm to about 10 cm, and more preferably about 10 mm to about 5 cm. The mask is designed to snugly fit around the mandrel circumference and thus the inside diameter of the mask corresponds approximately to the outside diameter of the mandrel. The mask may have any effective diameter and preferably has an inside diameter, before positioning on the mandrel, ranging from about 3 cm to about 20 cm, and more preferably from about 5 cm to about 10 cm.

In embodiments, an optional effective parting gap may be created between a portion of the electroform and the mandrel to facilitate separation. Preferably, the parting gap ranges from about 0.1 mm to about 1 cm, and more preferably from about 0.1 mm to about 5 mm in width separating the electroform and the mandrel. The parting gap may be created by any suitable method including reliance on differences in the coefficients of thermal expansion between the mandrel and the article. Processes to create a parting gap are illustrated in Bailey et al., U.S. Pat. No. 3,844,906 and Herbert, U.S. Pat. No. 4,501,646, the disclosures of which are totally incorporated by reference.

The mandrel may have any effective design, and may be hollow or solid. The mandrel may have any effective cross-sectional shape such as cylindrical, oval, square, rectangular, or triangular. In embodiments, the mandrel has tapered sides. A preferred mandrel has an ellipsoid or parabolic shaped end, with the mandrel profite preferably like that illustrated in Herbert et al., U.S. Pat. No. 4,902,386, the disclosure of which is totally incorporated by reference. Such a mandrel with an ellipsoid or parabolic shaped end is preferred since the resulting electroform will have a corresponding ellipsoid or parabolic shaped end which provides a gripping surface. Any damage to the ellipsoid or parabolic shaped end of the electroform during parting is generally of no consequence since the end may be discarded, such as by cutting off, in the processing of photoreceptor substrates. The top end of the mandrel may be open or closed, flat or of any other suitable design. The mandrel may be of any suitable dimensions. For example, the mandrel may have a length ranging from about 5 cm to about 100 cm; and an outside diameter ranging from about 5 cm to about 30 cm. The mandrel may be fabricated from any suitable material, preferably a metal such as aluminum, nickel, steel, iron, copper, and the like.

An optional hole or slight depression at the end of the mandrel is desirable to function as a bleeding hole to facilitate more rapid removal of the electroformed article from the mandrel. The bleed hole prevents the deposition of metal at the apex of the tapered end of the mandrel during the electroforming process so that ambient air may enter the space between the mandrel and the electroformed article during removal of the article subsequent to electroforming. The bleed hole should have sufficient depth and circumference to prevent hole blocking deposition of metal during electroforming. For a small diameter mandrel having an outside diameter between about 1/16 inch (0.2 mm) and about 2.5 inches (63.5 mm) a typical dimension for bleed hole depth ranges from about 3 mm to about 14 mm and a typical dimension for circumference ranges from about 5 mm and about 15 mm. Other mandrel diameters such as those greater than about 63.5 mm may also utilize suitable bleed holes having dimensions within and outside these depth and circumference ranges.

The mandrel may be optionally plated with a protective coating. The plated coating is generally continuous except for areas that are masked or to be masked and may be of any suitable material. Typical plated protective coatings for mandrels include chromium, nickel, alloys of nickel, iron, and the like. The plated metal should preferably be harder than the metal used to form the electroform and is of an effective thickness of for example at least 0.006 mm in thickness, and preferably from about 0.008 to about 0.05 mm in thickness. The outer surface of the plated mandrel preferably is passive, i.e., abhesive, relative to the metal that is electrodeposited to prevent adhesion during electroforming. Other factors that may be considered when selecting the metal for plating include cost, nucleation, adhesion, oxide formation and the like. Chromium plating is a preferred material for the outer mandrel surface because it has a naturally occurring oxide and surface resistive to the formation of a strongly adhering bond with the electro-deposited metal such as nickel. However, other suitable metal surfaces could be used for the mandrels. The mandrel may be plated using any suitable electrodeposition process. Processes for plating a mandrel are known and described in the patent literature. For example, a process for applying multiple metal platings to an aluminum mandrel is described in U.S. Pat. Nos. 4,067,782, and 4,902,386, the disclosures of which are totally incorporated by reference.

Articles may be formed on the mandrels of this invention by any suitable known process, preferably electroforming. The electroformed articles may be of any effective thickness, preferably from about 1 mm to about 2 cm, and more preferably from about 2 mm to about 20 mm. The electroforming material and the electroformed articles may be of any suitable metal including nickel, copper, iron, steel, or aluminum.

Processes for electroforming articles on the mandrel are also well known and described, for example, in U.S. Pat. Nos. 4,501,646 and 3,844,906, the disclosures of which are totally incorporated by reference. The electroforming process of this invention may be conducted in any suitable electroforming device. For example, a plated cylindrically shaped mandrel having an ellipsoid shaped end may be suspended vertically in an electroplating tank. The electrically conductive mandrel plating material should be compatible with the metal plating solution. For example, the mandrel plating may be chromium. The top edge of the mandrel may be masked off with a suitable non-conductive material, such as wax to prevent deposition. The electroplating tank is filled with a plating solution and the temperature of the plating solution is maintained at the desired temperature such as from about 45° to about 65° C. The electroplating tank can contain an annular shaped anode basket which surrounds the mandrel and which is filled with metal chips. The anode basket is disposed in axial alignment with the mandrel. The mandrel is connected to a rotatable drive shaft driven by a motor. The drive shaft and motor may be supported by suitable support members. Either the mandrel or the support for the electroplating tank may be vertically and horizontally movable to allow the mandrel to be moved into and out of the electroplating solution. Electroplating current such as from about 25 to about 400 amperes per square foot can be supplied to the electroplating tank from a suitable DC source. The positive end of the DC source can be connected to the anode basket and the negative end of the DC source connected to a brush and a brush/split ring arrangement on the drive shaft which supports and drives the mandrel. The electroplating current passes from the DC source to the anode basket, to the plating solution, the mandrel, the drive shaft, the split ring, the brush, and back to the DC source. In operation, the mandrel is lowered into the electroplating tank and continuously rotated about its vertical axis. As the mandrel rotates, a layer of electroformed metal is deposited on its outer surface. When the layer of deposited metal has reached the desired thickness, the mandrel is removed from the electroplating tank.

Any suitable method and apparatus may be optionally employed to assist in the removal of the electroformed article from the mandrel. For example, a mechanical parabolic end parting fixture may be employed to grasp the preferably parabolic shaped end of the electroform. The grasping jaws may have as few as three fingers or may completely contact the electroform circumference like a lathe collet. Alternatively, a vacuum cup may be placed under the preferably parabolic shaped end of the mandrel. A vacuum would be generated by the use of air pressure or vacuum pump. In another approach, the electroform/mandrel composite structure is inserted into an induction coil and by energizing the coil the electroform is heated and consequently enlarges, thereby loosening it from the mandrel. In a different approach, vibrational energy, especially ultrasonic energy, is used to cause the electroform to separate from the mandrel. In one embodiment, an ultrasonic bath is used during or after the parting gap is established to assist in removal of the electroform. It is also possible to use a vibrator which contacts the electroform or the mandrel.

Other modifications of the present invention may occur to those skilled in the art based upon a reading of the present disclosure and these modifications are intended to be included within the scope of the present invention.

What is claimed is:

1. A method for separating an electroformed article from a mandrel comprising:

(a) masking a portion of a mandrel with a mask comprising an electrically nonconductive outer surface;

(b) electroforming an article on the mandrel wherein the electroforming material is deposited on the mandrel surface and substantially fails to adhere to or does not adhere to the nonconductive outer surface of the mask, whereby the end of the electroformed article is adjacent to the mask; and (c) removing the article from the mandrel by: (i) pushing the mask against the end of the article to effect movement of the article in the direction of separation; or (ii) removing the mandrel while keeping the mask stationary, whereby the end of the article pushes against the mask during withdrawal of the mandrel.

2. The method of claim 1, wherein the mask in step (a) is positioned around the mandrel at the top end thereof.

3. The method of claim 1, comprising step (c)(i).

4. The method of claim 1, comprising step (c)(ii).

5. The method of claim 1, wherein the electroforming material comprises nickel, copper, iron, steel or aluminum.

6. The method of claim 1, wherein the mandrel is fabricated from nickel, copper, iron, steel, or aluminum.

7. The method of claim 1, wherein the mask is elastic.

8. The method of claim 1, wherein the mask comprises a polymeric material.

9. The method of claim 1, wherein the mask comprises butyl rubber.

10. The method of claim 1, wherein the mask has a thickness ranging from about 2 mm to about 1 cm.

11. The method of claim 1, wherein the mask has a length ranging from about 10 mm to about 5 cm.

12. The method of claim 1, wherein the coefficient of static friction between the mandrel surface and the mask inner surface ranges from about 0.05 to about 1.

13. The method of claim 1, wherein the coefficient of static friction between the mandrel surface and the mask inner surface ranges from about 0.05 to about 0.50.

14. A method for separating an electroformed article from a mandrel comprising:

(a) positioning around a mandrel at the top end a mask comprising an electrically nonconductive outer surface;

(b) electroforming an article on the mandrel wherein the electroforming material is deposited on the mandrel surface and substantially fails to adhere to or does not adhere to the nonconductive outer surface of the mask, whereby the end of the electroformed article is adjacent to the mask; and (c) removing the article from the mandrel by pushing the mask against the end of the article to effect movement of the article in the direction of separation.

* * * * *